US006568907B2

(12) United States Patent
Horng et al.

(10) Patent No.: US 6,568,907 B2
(45) Date of Patent: May 27, 2003

(54) IMPELLER STRUCTURE

(75) Inventors: Alex Horng, Kaohsiung (TW); Aven Lee, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 0 days.

(21) Appl. No.: 09/964,729

(22) Filed: Sep. 28, 2001

(65) Prior Publication Data

US 2003/0063976 A1 Apr. 3, 2003

(51) Int. Cl.[7] ..... F04D 29/38
(52) U.S. Cl. ..... 416/185; 416/228; 416/236 R
(58) Field of Search ..... 416/179, 182, 416/183, 184, 185, 228, 235, 236 R

(56) References Cited

U.S. PATENT DOCUMENTS 1,536,306 A * 5/1925 Nusim ..... 416/184
5,605,444 A * 2/1997 Paton et al. ..... 416/183
2002/0159885 A1 * 10/2002 Liang et al. ..... 415/206

* cited by examiner

*Primary Examiner*—Edward K. Look
*Assistant Examiner*—Dwayne J. White
(74) *Attorney, Agent, or Firm*—Bacon & Thomas, PLLC

(57) ABSTRACT

An impeller structure includes a hub provided with a rotation shaft that may be pivoted to rotate. The hub has a periphery provided with an annular plate connected with the hub. A plurality of blades each have one end fixed to the annular plate and connected with a top face and a bottom face of the annular plate. The blades are extended outward from the hub in a radiating manner.

5 Claims, 6 Drawing Sheets

IMPELLER STRUCTURE

BACKGROUND OF THE INVENTION

1. Field of the Invention

The present invention relates to an impeller structure, and more particularly to an impeller structure that may have a dual directional air inlet effect, and have a better air inlet and air outlet effect.

2. Description of the Related Art

A conventional blast type fan in accordance with the prior art shown in FIG. 1 comprises a casing 90 whose eddy channel is provided with a stator 91. An impeller 92 is pivoted on the stator 91 to rotate. The casing 90 is covered by a cover plate 93 which has an air inlet 94. By rotation of the impeller 92, the cool air is sucked into the air inlet 94 by the blades 95, and is drained outward from the air outlet 96. The conventional blast type fan only has a single air inlet 94 and a single air outlet 96. Thus, the conventional blast type fan can drive a smaller amount of cool air only, so that the heat dissipation effect thereof is not good enough.

Another conventional blast type fan in accordance with the prior art shown in FIG. 2 comprises a casing 80 having all air outlet 86 and having a bottom plate combined with a stator 81 and provided with an air inlet 87. Thus, when an impeller 82 of the fan is pivoted on the stator 81, rotation of the impeller 82 may suck the cool air from the air inlet 84 by the blades 85, and the air inlet 87 on the bottom plate of the casing 80 may also provide an auxiliary effect to suck part of the cool air. The air may be drained outward from the air outlet 86. The conventional blast type fan may provide an auxiliary effect to suck part of the cool air, thereby achieving the dual directional air inlet from the top and the bottom, so as to increase the heat dissipation effect. However, when the cool air is sucked from the air inlet 84 of the cover plate 83 and the air inlet 87 of the bottom plate, the cool air respectively sucked from the top and the bottom will hit each other to form a turbulent flow. Thus, the effect of heat dissipation is limited. In addition, noise will be generated during rotation.

SUMMARY OF THE INVENTION

The primary objective of the present invention is to provide an impeller structure, wherein the fan may efficiently increase the air inlet amount, so that the fan may have a better heat dissipation effect.

In accordance with the present invention, there is provided an impeller structure including a hub provided with a rotation shaft that may be pivoted to rotate. The hub has a periphery provided with an annular plate connected with the hub. A plurality of blades each have one end fixed to the annular plate and connected with a top face and a bottom face of the annular plate. The blades are extended outward from the hub in a radiating manner.

Further benefits and advantages of the present invention will become apparent after a careful reading of the detailed description with appropriate reference to the accompanying drawings.

DETAILED DESCRIPTION OF THE PREFERRED EMBODIMENTS

Figure 1:
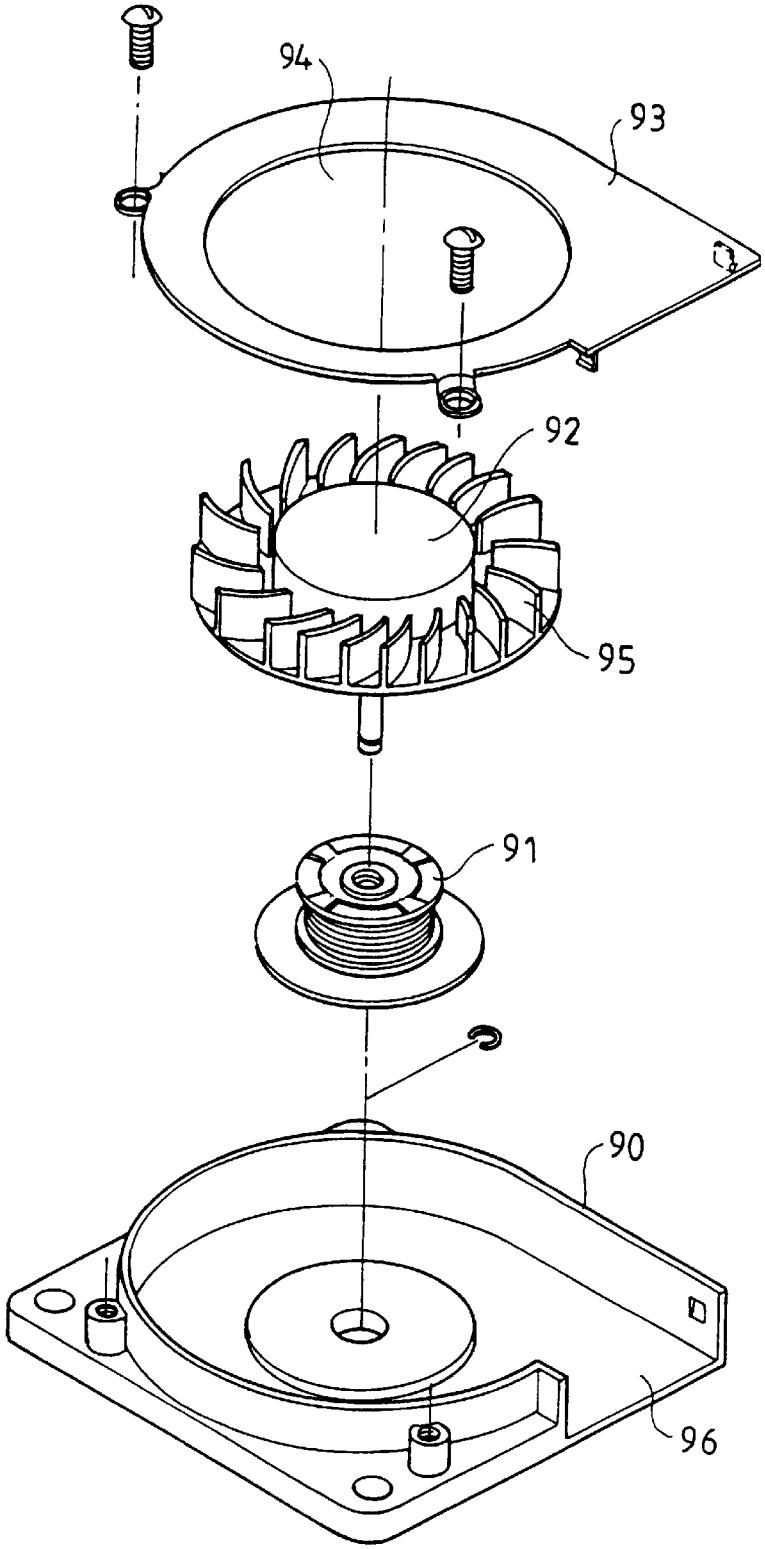
FIG.1 PRIOR ART
FIG. 1 is an exploded perspective view of a conventional blast type fan in accordance with the prior art.
Figure 2:
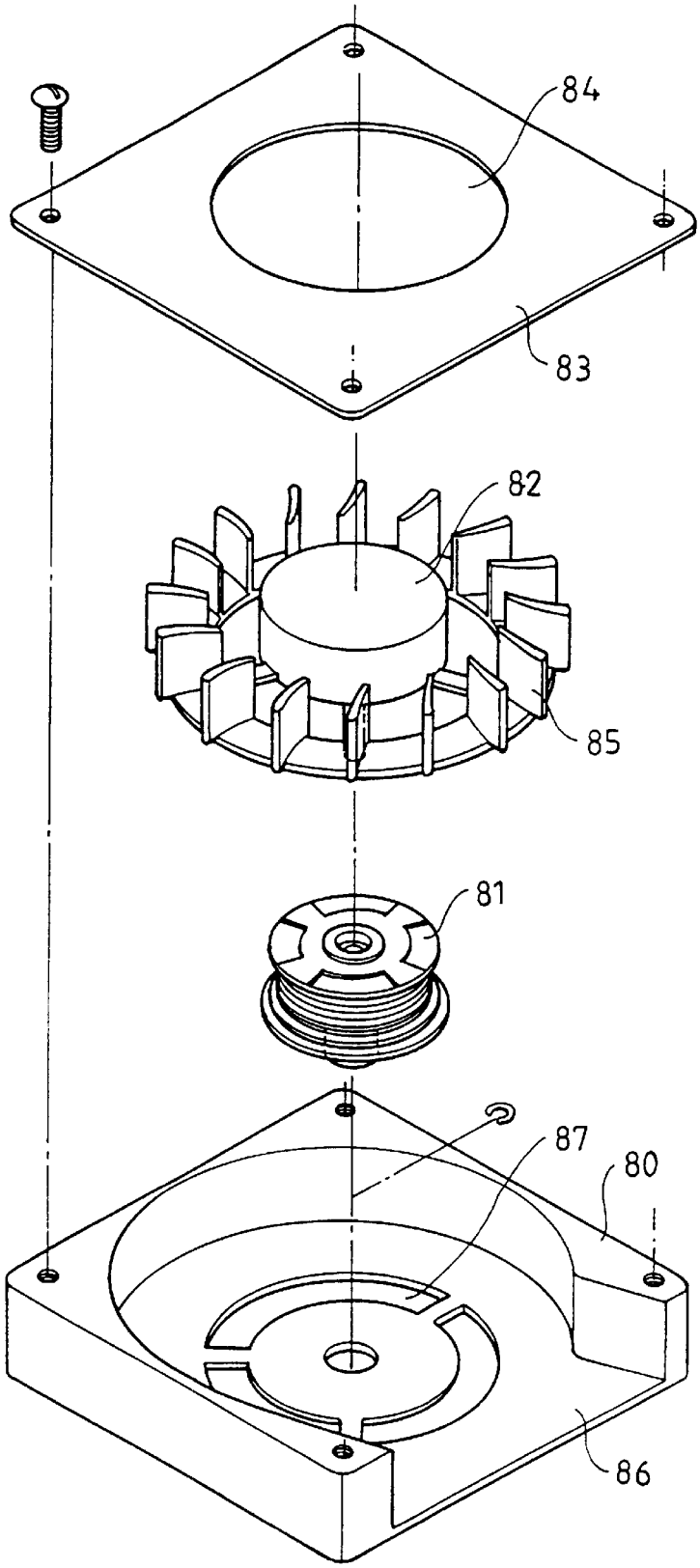
FIG. 2 is another exploded perspective view of a conventional blast type fan in accordance with the prior art.
Figure 3:
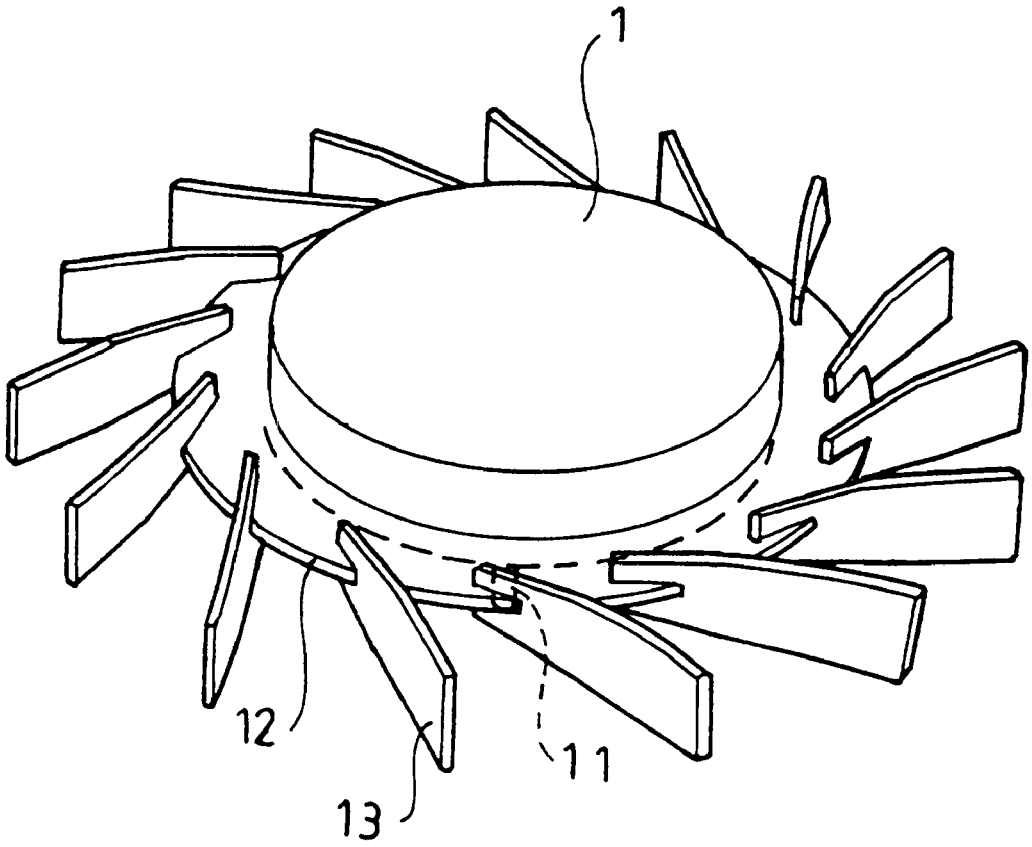
FIG. 3 is a perspective view of an impeller structure in accordance with a first embodiment of the present invention.
Figure 5:
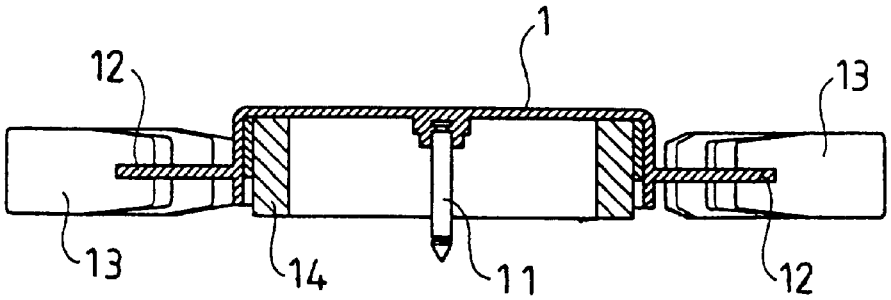
FIG. 5 is a cross-sectional assembly view of the impeller structure along line 5—5 as shown in FIG. 4.

Referring to the drawings and initially to FIG. 3, an impeller structure in accordance with a first embodiment of the present invention comprises a hub 1 provided with a rotation shaft 11 that may be pivoted to rotate as shown in FIG. 5. The hub 1 has a periphery provided with an annular plate 12 that is closely connected with the hub 1 without any gap formed therebetween. A plurality of blades 13 each have one end fixed to the annular plate 12. The fixed end of each blade 13 is connected with the top and bottom faces of the annular plate 12 simultaneously. The other ends of the blades 13 are extended outward from the hub 1 in a radiating manner.

Figure 4:
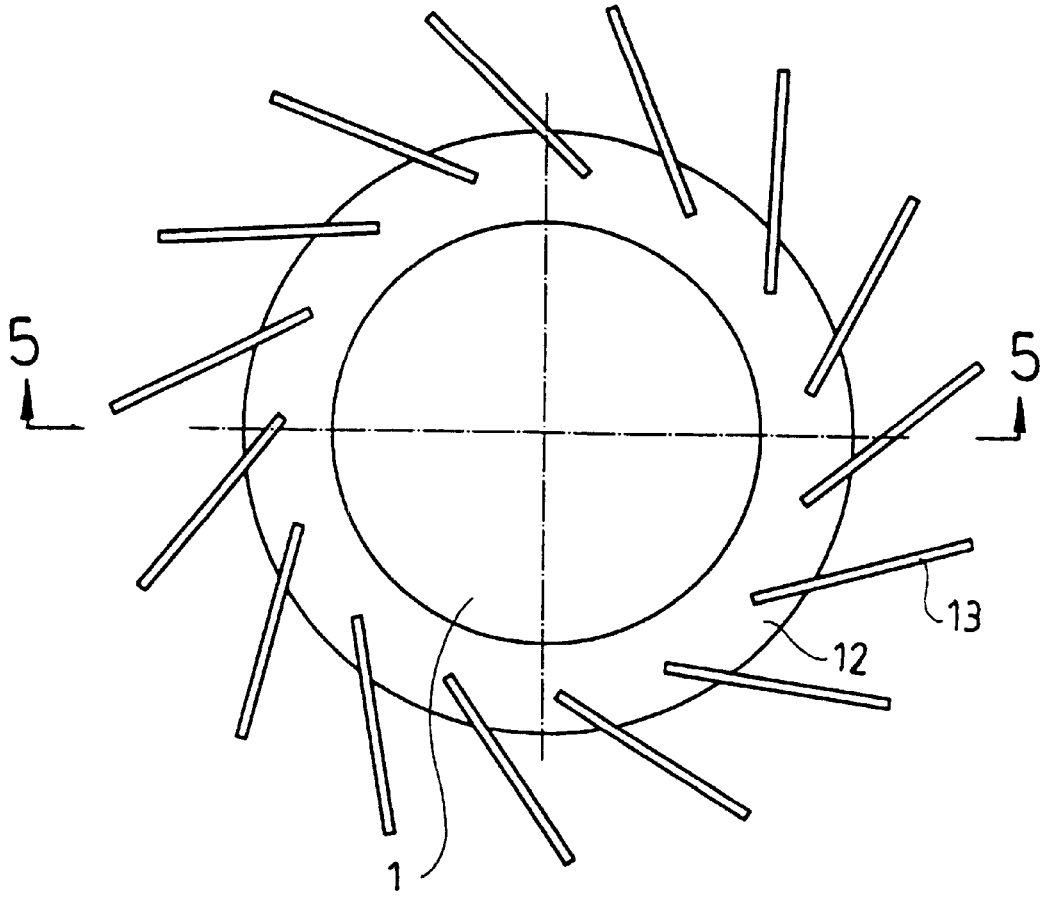
FIG. 4 is a top plan view of the impeller structure as shown in FIG. 3.

Referring to FIGS. 4 and 5, the combination situation of the impeller structure in accordance with the first embodiment of the present invention is shown. The rotation shaft 11 of the hub 1 is pivoted on a stator to rotate. A permanent magnet 14 is mounted in the hub 1. The periphery of the hub 1 is provided with an annular plate 12, and one end of each blade 13 is connected with the top and bottom faces of the annular plate 12 simultaneously.

Figure 6:
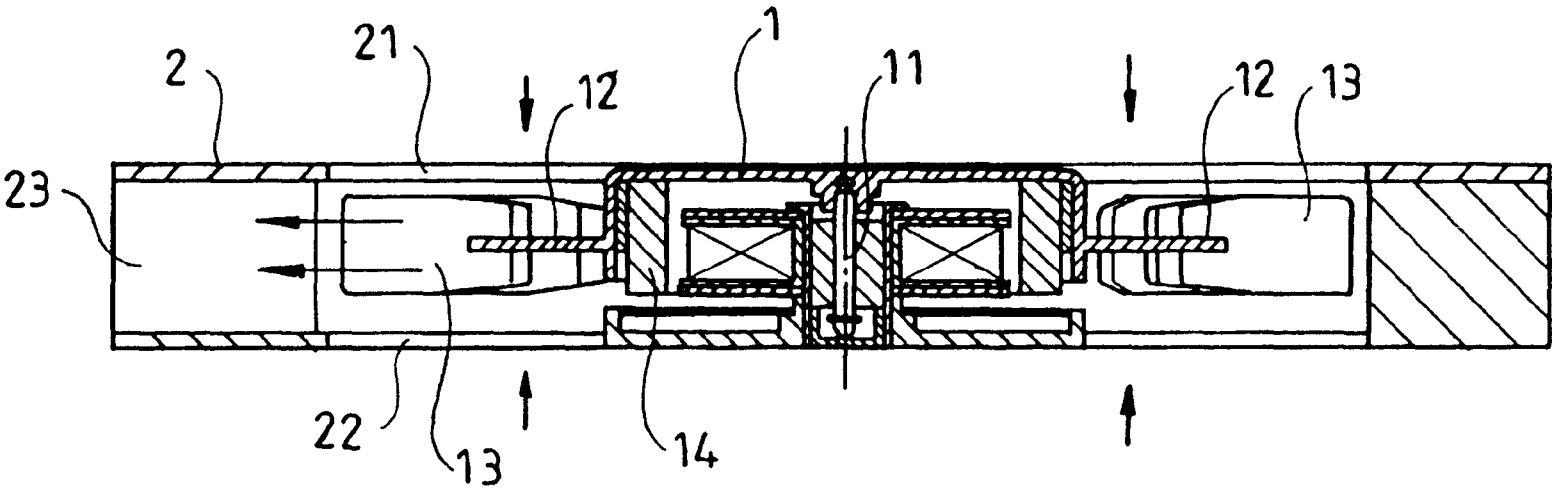
FIG. 6 is a cross-sectional assembly view of a usage example of the first embodiment of the present invention.

Referring to FIG. 6, the usage situation of the impeller structure in accordance with the first embodiment of the present invention is shown. The blades 13 are spaced from hub 1 so that they may suck the cool air from the upper air inlet 21 and the lower air inlet 22 of the fan casing into the resulting top and bottom annular spaces formed between the hub and the ends of the blades and separated by the annular plate, the top and bottom annular spaces being respectively aligned with the upper and lower air inlets 21 and 22, as shown in FIG. 6. The sucked cool air is separated by the annular plate 12, so that the cool air sucked from two different directions will not interfere with each other. The cool air will be driven by the blades 13 to be drained outward from the air outlet 23 of the fan casing 2. Thus, the dual directional air inlet impeller structure of the present invention may increase the input and output amount of cool air. Relatively, the present invention has a better heat dissipation effect, and may efficiently decrease noise generated during rotations.

Figure 7:
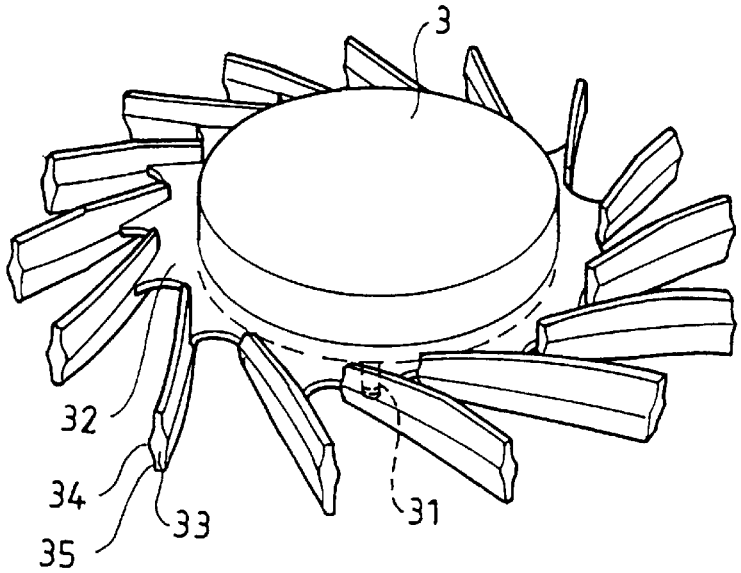
FIG. 7 is a perspective view of an impeller structure in accordance with a second embodiment of the present invention.
Figure 8:
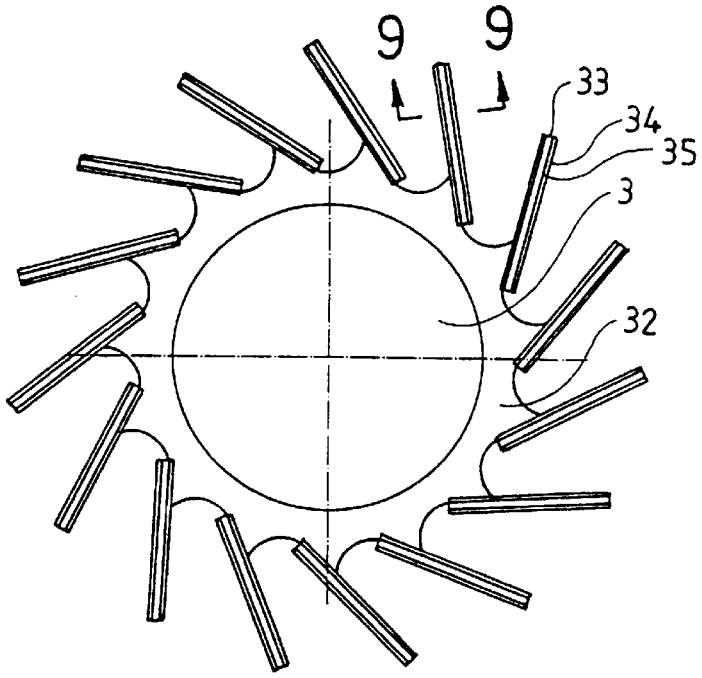
FIG. 8 is a top plan view of the impeller structure as shown in FIG. 7.
Figure 9:
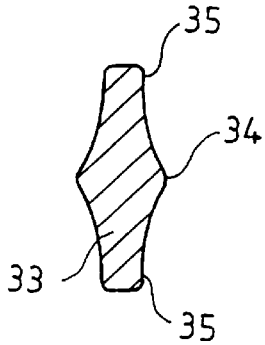
FIG. 9 is a cross-sectional view of the impeller structure along line 9—9 as shown in FIG. 8.

Referring now to FIG. 7, an impeller structure in accordance with a second embodiment of the present invention comprises a hub 3 provided with a rotation shaft 31 that may be pivoted to rotate. The hub 3 has a periphery integrally formed with an annular plate 32 which has a gear-shape. Each tooth side of the gear-shaped annular plate 32 is provided with an outward extended blade 33. Each blade 33 has one end connected with the top and bottom faces of the annular plate 32 simultaneously. In addition, each blade 33 has two side blade faces each having a mediate portion formed with a protruded shoulder portion 34, and thinner wing tail portions 35 are formed from the shoulder portion 34 toward the top and bottom ends of the blade 33 as shown in FIG. 9. An arcuate concave face may be formed between the shoulder portion 34 and the wing tail portion 35. Thus, when the hub 3 is rotated, the blades 33 may have a better effect to drive the air flow. Further, the annular plate 32 is formed with a gear-shape. Thus, when the hub 3 is rotated, the cool air driven by the blades 33 may be drained quickly along the blades 33, and will not form a dead corner at the combination portion of the top and bottom faces of the annular plate 32 and the blades 33. Thus, the dual directional air inlet impeller structure of the present invention may have a better heat dissipation effect.

Accordingly, in accordance with the impeller structure of the present invention, when the hub is rotated, the blades may drive the air to flow from the top and bottom sides of the hub, and the air flow may be separated by the annular plate. Thus, the cool air sucked from two different directions will not hit each other to form a turbulent flow, and the cool air is driven by the blades to be drained outward from the air outlet of the fan casing. Thus, the dual directional air inlet impeller structure of the present invention may increase the input and output amount of the cool air. Relatively, the present invention may have a larger cool air driving amount, and may have a better heat dissipation effect.

In addition, the annular plate mounted on the periphery of the hub may be formed with a gear-shape. Thus, the cool air driven by the blades may be drained quickly along the blades, and will not form a dead corner at the combination portion of the top and bottom faces of the annular plate and the blades. Thus, the dual directional air inlet impeller structure of the present invention may have a better heat dissipation effect.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. An impeller structure, comprising:

a hub provided with a rotation shaft, said hub having a periphery provided with an annular plate connected with said hub; and a plurality of blades each having one end fixed to said annular plate and connected with a top face and a bottom face of said annular plate, wherein said one end of each of said blades is spaced from said hub to form top and bottom annular spaces between said hub and said one ends of said blades, said top and bottom annular spaces being separated by said annular plate, said top annular space being aligned with an upper air inlet, and said bottom annular space being aligned with a lower air inlet.

2. The impeller structure as claimed in claim 1, wherein said annular plate is formed with a gear-shape.

3. The impeller structure as claimed in claim 2, wherein each tooth side of said gear-shaped annular plate is provided with an outward extended blade.

4. The impeller structure as claimed in claim 1, wherein each blade has two side blade faces having a mediate portion formed with a protruded shoulder portion, and a top end and a bottom end each formed with a thinner wing tail end.

5. The impeller structure as claimed in claim 4, wherein an arcuate concave face is formed between said shoulder portion and said wing tail portion of each blade.

* * * * *